US006560602B1

(12) United States Patent
Carter

(10) Patent No.: US 6,560,602 B1
(45) Date of Patent: May 6, 2003

(54) CERTIFIED MAILER AND METHOD OF USING THE SAME

(76) Inventor: William Thomas Carter, 2410 Valleydale Rd., Birmingham, AL (US) 35244

( * ) Notice: Subject to any disclaimer, the term of this patent is extended or adjusted under 35 U.S.C. 154(b) by 0 days.

(21) Appl. No.: 09/335,960

(22) Filed: Jun. 18, 1999

(51) Int. Cl.[7] ..... G06F 17/30; G06F 15/00; B65D 27/00

(52) U.S. Cl. ..... 707/10; 715/513; 715/527; 229/92.1

(58) Field of Search ..... 707/517, 505, 707/10, 104.1, 203, 4, 100, 102, 1; 235/517; 229/92.1; 462/65; 493/183; 705/400–410

(56) References Cited

U.S. PATENT DOCUMENTS 4,896,823 A * 1/1990 Taylor ..... 229/73
5,325,303 A * 6/1994 Walz et al. ..... 705/404
5,642,855 A * 7/1997 Michlin ..... 229/305
5,860,904 A 1/1999 Petkovsek ..... 493/183
5,862,978 A * 1/1999 Forrest ..... 229/70
5,873,073 A * 2/1999 Bresnan et al. ..... 705/410
5,901,903 A * 5/1999 Sanders et al. ..... 229/69
5,978,781 A * 11/1999 Sansone ..... 705/408
5,987,461 A * 11/1999 Dreyer et al. ..... 707/7
6,039,242 A 3/2000 Tee ..... 229/92.1
6,088,710 A * 7/2000 Dreyer et al. ..... 707/517
6,157,924 A * 12/2000 Austin ..... 707/10
6,178,411 B1 * 1/2001 Reiter ..... 705/408
6,408,287 B1 * 6/2002 Sansone et al. ..... 705/410

OTHER PUBLICATIONS

Beaudoin, James S. and Roske, Edward, "Printed Labels For Postal Indicia", PCT International Application WO 97/21203, Jun. 12, 1997, pp. 2–10.*

* cited by examiner

*Primary Examiner*—Hani M. Kazimi
*Assistant Examiner*—Ella Colbert
(74) *Attorney, Agent, or Firm*—Smith, Gambrell & Russell, LLP

(57) ABSTRACT

A single sheet mailer which incorporates a detachable certified mail return receipt having a bar-code, a readable return address window, a message window, address window, the acceptable coloration, and a security imprint from the Postal Service. To utilize the mailer an address list and a standard message may be utilized with the mail-merge function of a word processing program to print the message and address multiple copies of the message to recipients, address the detachable return receipt, and all other information needed on the document. The document is then folded along predetermined foldlines and sealed along marginal edges, such that upon receipt the return receipt card can be detached without opening the portion of the mailer containing the message. The card may be processed electronically by the post office, thereby facilitating its return.

9 Claims, 5 Drawing Sheets

CERTIFIED MAILER AND METHOD OF USING THE SAME

BACKGROUND AND SUMMARY OF THE INVENTION

Z-fold or C-fold mailer-type business forms formed of a single sheet of approximately 8½×14 inch paper, paper weight of 90–100 lbs., have become a very fast, cost-effective, and efficient mailing and distribution system which can be mailed at regular postage rates. Such mailer forms are sold, for example, by Moore Business Forms, Inc. of Lake Forest, Ill., and may be processed on both impact and non-impact printers. One type of such form uses heat-activated adhesive with marginal portions detachable along four edges of the form, while another uses pressure sensitive adhesive with the outside detachable along three edges, and with the interior panel detachable along a fourth.

While mailers have become a very common type of business form, some mailers are ineffective or obsolete when used with current postal service technology or with restrictions concerning the placement of the address information on mailers. Likewise, thickness restrictions relating to the capabilities of printers reduce the effectiveness of certain mailers. Of particular concern in the present application is a mailer and method for using the same for certified mail. Certified mail presents certain problems in mail handling in that the regulations specify that the return receipt and mailer be of a certain green coloration which is not amenable to optical scanning of bar-code information. Therefore, regular mail which can be bar-coded, scanned, sorted, and distributed, can be processed much faster than certified mail which is predominately manually sorted.

The present invention provides a single sheet mailer which incorporates a detachable certified mail return receipt having a bar-code readable return address window, a message window, address window, the acceptable coloration, and a security imprint from the Postal Service. To utilize the mailer an address list and a standard message may be utilized with the mail-merge function of a common word processor to print a specified message and address multiple copies of the message to recipients, address the detachable return receipt, and all other information needed on the document. The document is then folded along predetermined foldlines and sealed along marginal edges, such that upon receipt the return receipt card can be detached. The card may be processed electronically by the post office, thereby facilitating its return.

BRIEF DESCRIPTION OF THE DRAWINGS

A mailer embodying features of the present invention is depicted in the accompanying drawings which form a portion of this disclosure and wherein.

DESCRIPTION OF A PREFERRED EMBODIMENT

Figure 1:
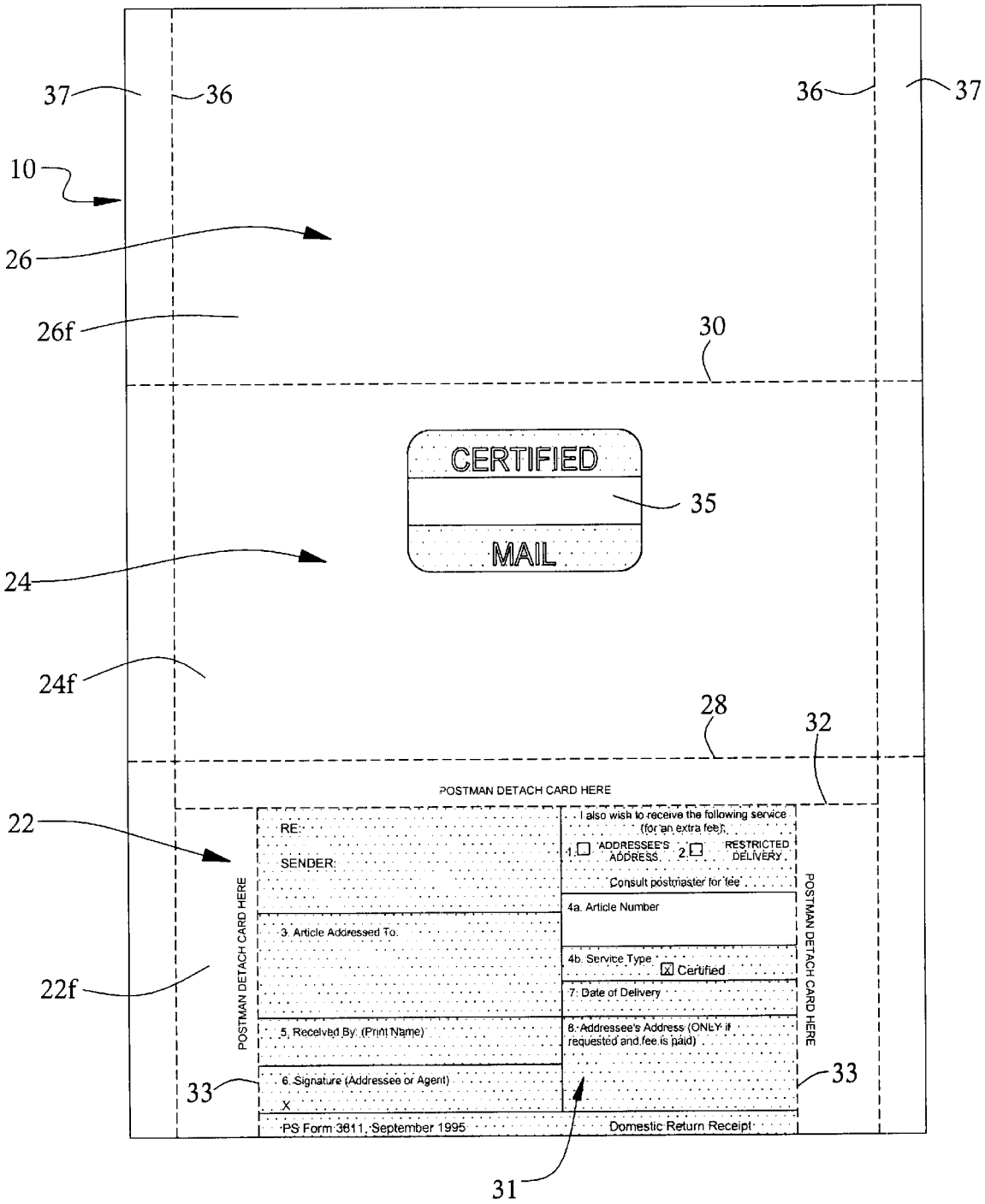
FIG. 1 is a plan view of a front face of the mailer.
Figure 2:
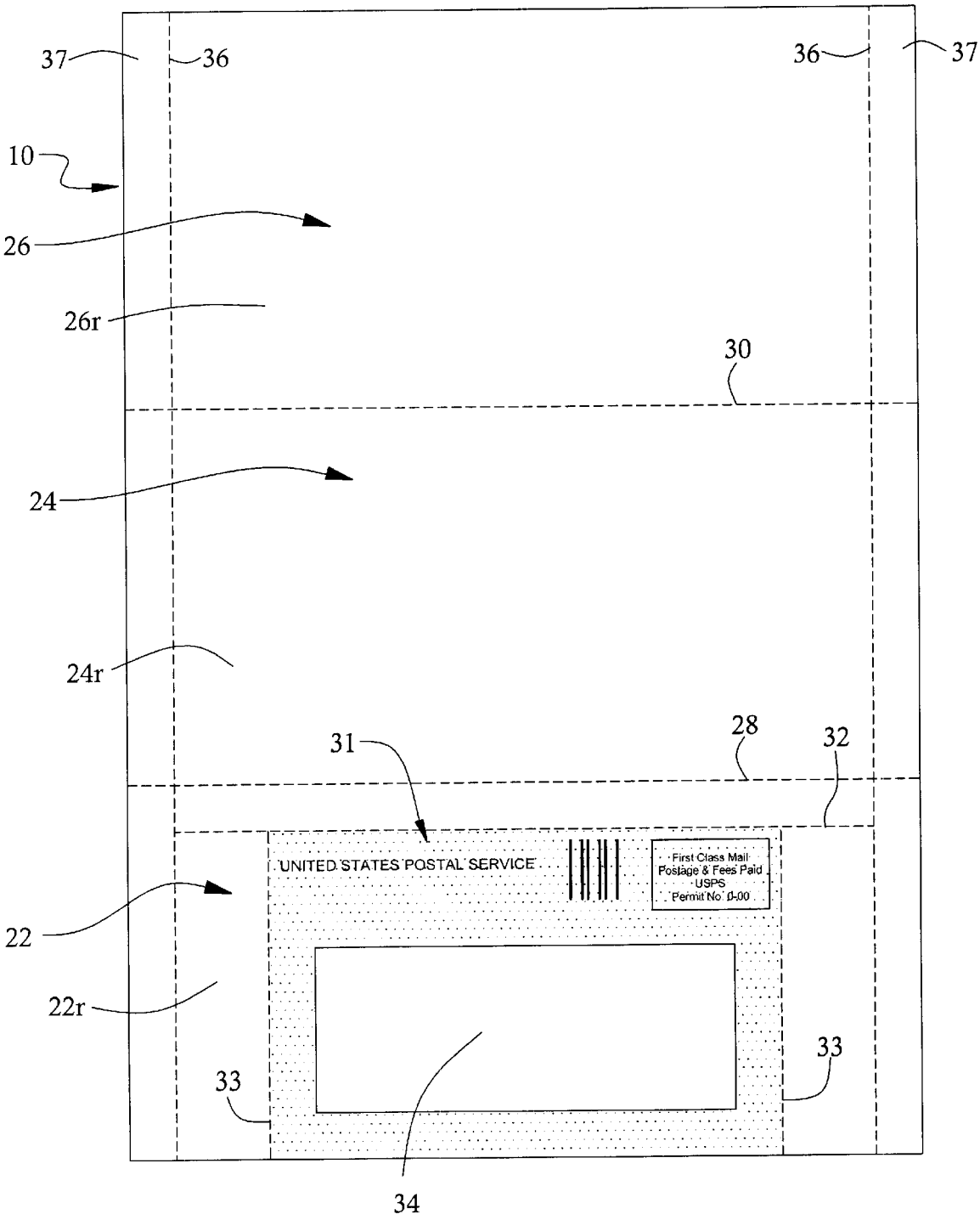
FIG. 2 is a plan view of a rear face of the same mailer.

Referring to the drawings for a clearer understanding of the invention it may be seen in FIGS. 1 and 2 that the present invention comprises a single sheet certified mailer 10 which has no need for any additional components or detachable and transferable overlays to serve as labels or address indicia. Single sheet mailer 10 is divided into first, second and third panels 26, 24 and 22, respectively. The second and third panels 24, and 22 are joined one to the other along a transversely extending foldline 28 which may comprise a line of perforations. The first and second panels 26 and 24 are connected one to the other along a second foldline which preferably would not comprise a line of perforations 30. The term foldline is used herein to mean a weakened portion of the paper for purposes of folding the paper and does not necessarily include or exclude lines of perforations for purposes of separating one panel from the other, although preferably foldline 28 constitutes a line of perforations.

Figure 1A:
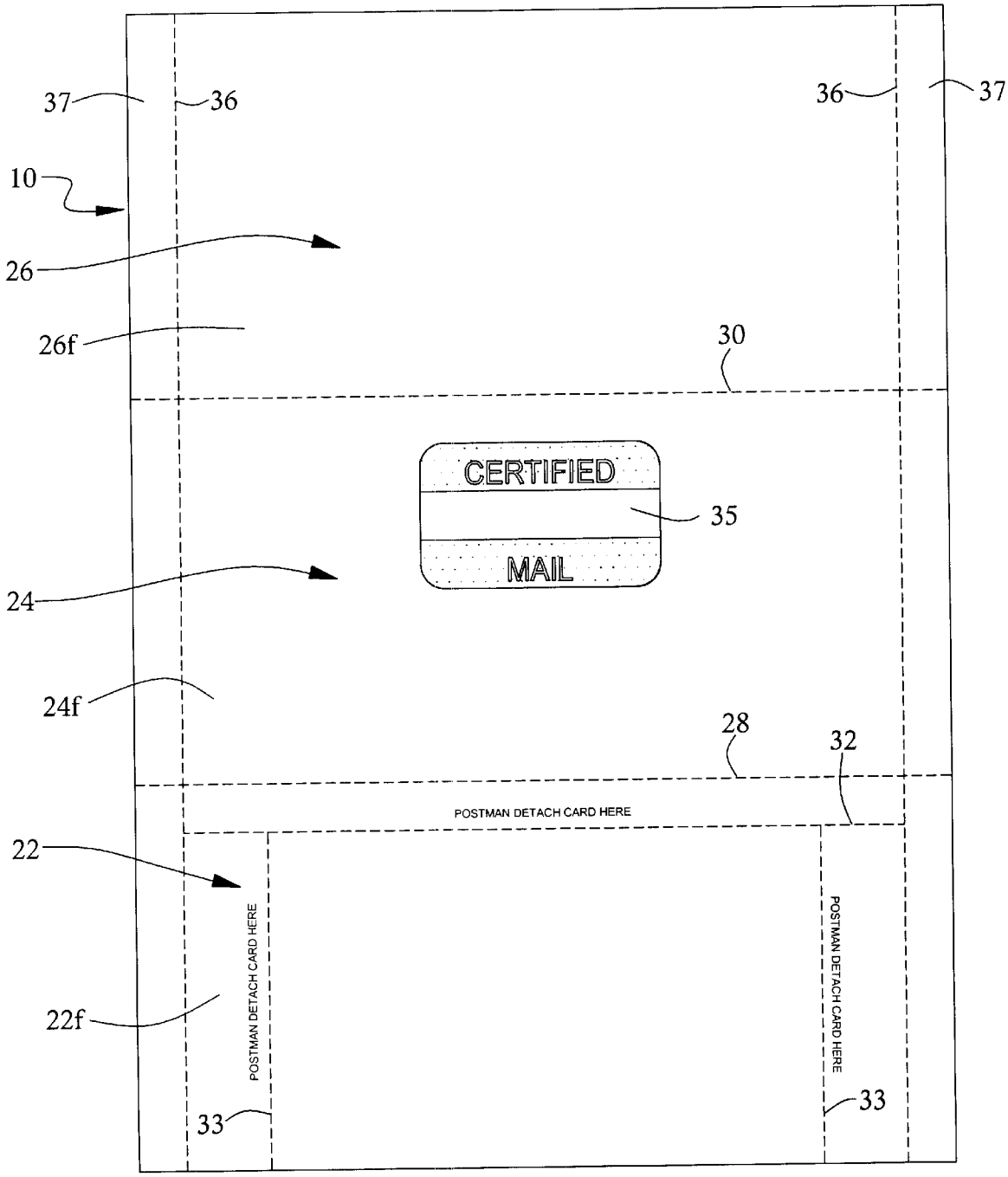
FIG. 1A is a plan view of an alternative with no return receipt.

Panel 22 is intended to form a return receipt card 31 for certified mail. Consequently, the panel includes a printing area in which the receipt card is printed, with the printed area being bounded by transverse and longitudinal lines of perforation 32 and 33 which allow return receipt card 31 to be removed from the rest of mailer 10. It should be understood that to form return receipt card 31, panel 22 must be printed on both front and rear faces, designated 22*f* and 22*r*, respectively in the figures. Face 22*f* is the article addressee face of receipt card 31 and has printed thereon the fields required of on PS Form 3811, for the article addressee face of a return receipt. As is well known, these cards are printed with a green background color in all of the fields except field 4*a*, wherein the Postal Service tracking number is printed and bar-coded. Face 22*r* is the return address face of return receipt card 31 and is printed with a green background color; however, unlike conventional postal return receipt cards, 22*r* has a non-colored field 34 bounded by the green background, within which the mailer user can type and bar-code the return address. Panel 24 is prepared with the certified mail article number field 35 printed on the front face 24*f* thereof, as well as the Postal Service IR identification indicia. The face of panel 24 serves as the outbound addressee field and the outbound postage field. Panel 26*f* has nothing printed on front face 26*f*. Neither panel 24 or 26 have anything printed on their rear faces 24*r* and 26*r*. FIG. 1A illustrates an alternative form wherein face 22*r* is blank.

Figure 3:
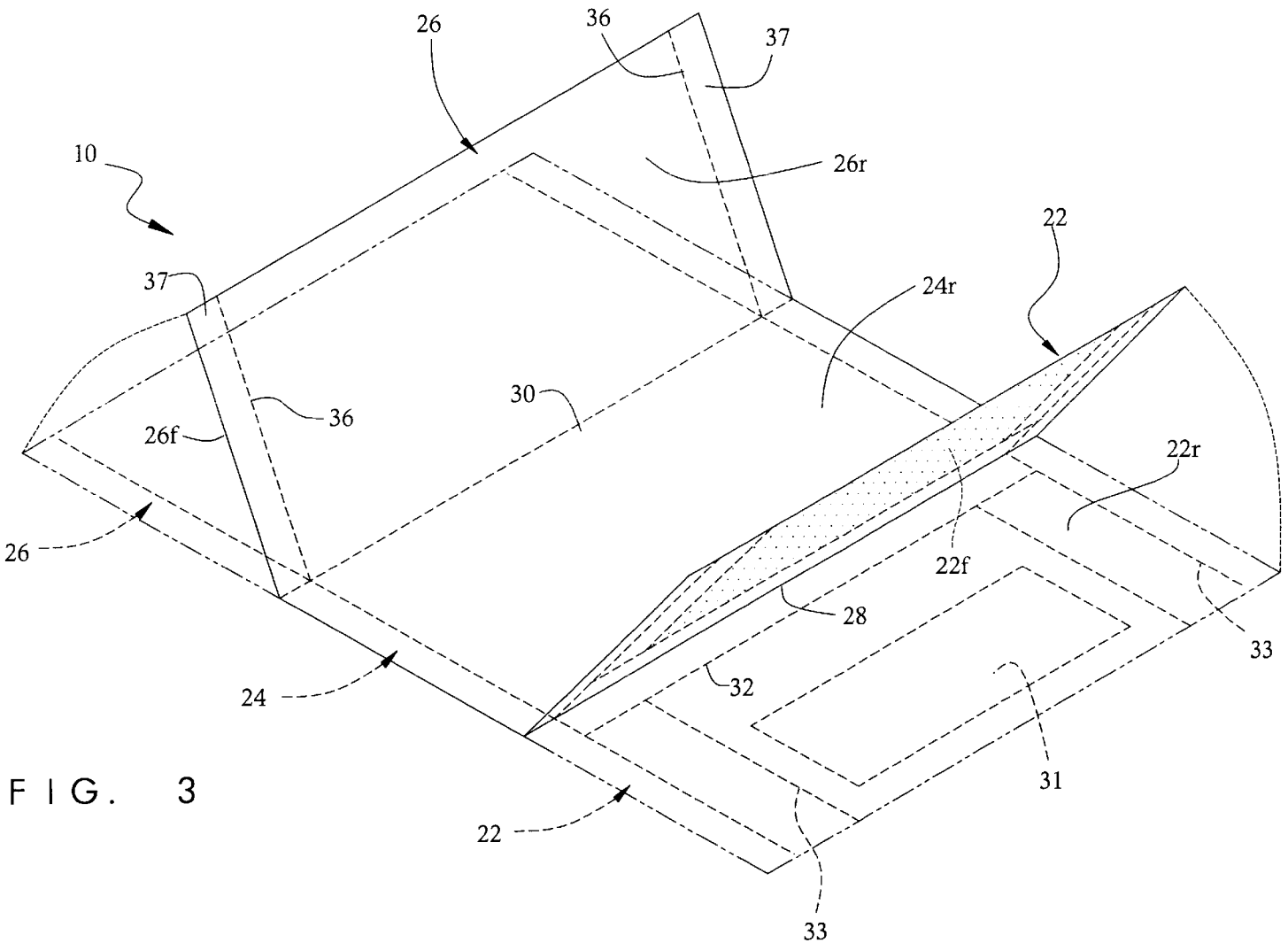
FIG. 3 is a perspective view of the mailer as it is being folded.

Panels 22, 24, and 26 are formed with longitudinal lines of perforation 36 forming marginal strips 37 perpendicular to foldlines 28 and 30. The marginal strips 37 have segments of adhesive material deposited thereon on panels 22*r*, 24*r*, 26*r*, and 26*f*. It will be appreciated that the segments of adhesive material allow for registration and adherence to corresponding segments of adhesive, to wit, as illustrated in FIG. 3, panel 26*r* folds over panel 24*r* along foldline 30 to provide registration of the adhesive of marginal strips 37 and panel 22*r* fold over panel 22*f* to provide registration of the adhesive material of the remaining marginal strips 37. In this manner, panel 26 is secured between panels 22 and 24 such that postal return receipt card 31 can be detached from the mailer along lines of perforation 32 and 33 without opening the mailer.

The mailer may be formed from suitable stock and printed by a commercial printer to yield the acceptable coloration and IR characteristics. Authorization for specified postal tracking numbers, can be obtained to allow sequential printing of these numbers on fields 4*a* and 35 of panels 22*f* and 24*f* respectively. In this manner, the mailer 10 includes a renumbered postal receipt card bearing the same number as the remainder of the mailer, which as hereinafter described contains the information to be conveyed to the outbound addressee. No labels need be removed or applied to the mailer to match the numbers.

Figure 4:
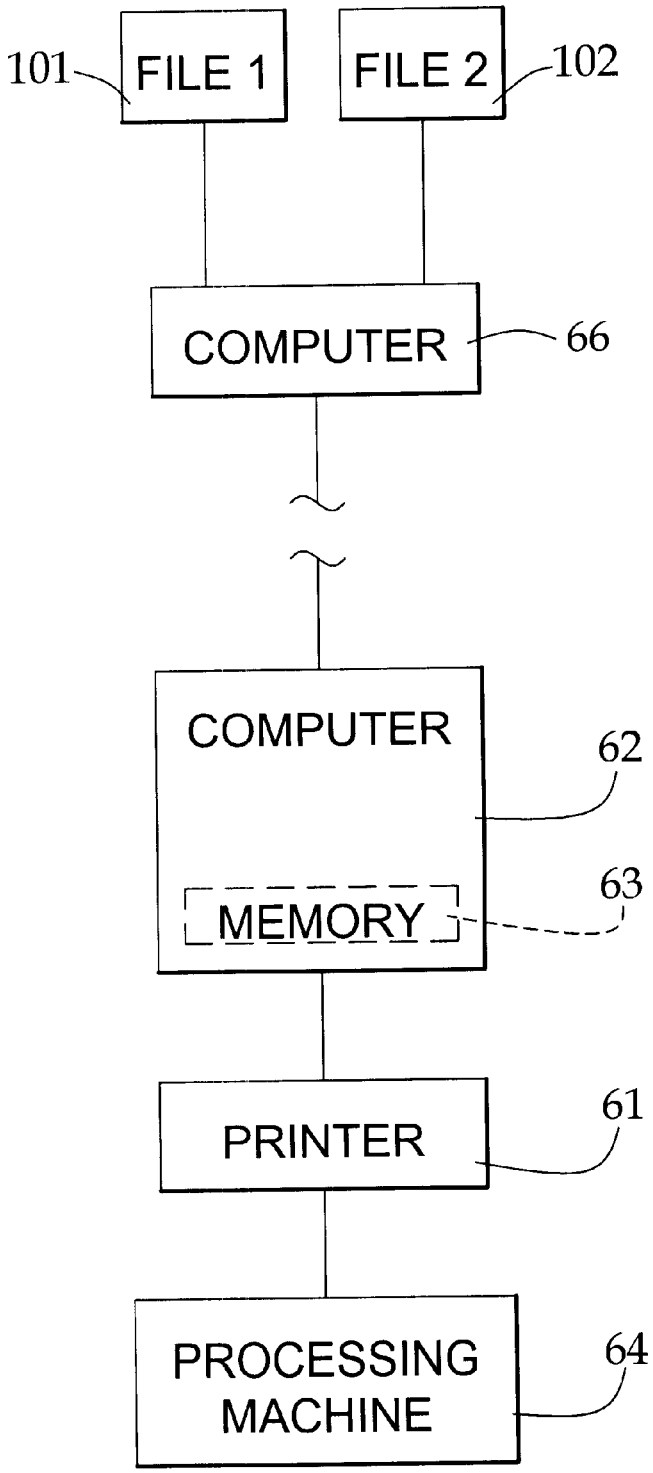
FIG. 4 is a flowchart of the use of the mailer.

FIG. 4 outlines the process utilized with the form. To use the mailer, a letter or message is printed on panels 24*r* and/or 26*r* and the return address is printed along with a bar-code in non-colored field 34 of panel 22*r* on the return receipt card. The outbound address is printed on panel 22*f* and 24*f*. More specifically, it is intended that the present mailer be used in mass-mailing situations wherein a printer 61, capable of dual-side printing, under the control of a computer 62, having a memory 63, in which data files are stored for manipulation and selective printing. Specifically, a first file 101 is produced containing text to convey necessary information to the recipient of 10; for example, statutory notices required to be sent to customers before taking legal action. A second file 102 containing the names and addresses of all recipients is produced; for example, the names of customers to whom such notices should be sent. These files may be created on a separate computer 66, either locally or remotely. After file 102 is received on computer 62 the names and addresses are sent through a program such as CASS (Coding Accuracy Support System) available from USSI, Birmingham, Ala., where the names and addresses are corrected for postal accuracy and barcoding. USSI is certified each year for this by the U.S. Postal service. Before printing and after CASS, the data is then sent through PAVE (Presort Accuracy Validation and Evaluation) system, also available from USSI, Birmingham, Ala. Here is where they are presorted for the maximum discounts and also for the fastest delivery possible for the certified mail. They are printed in the current order with all reports needed for the U.S. Post Office (USSI is also certified each year for this.) A program generally known as a mail-merge program, which are common in the computer arts is then utilized to merge the sequential list of names and information for printing on a series of mailers passing through the printer. Subsequent bar-code scanning of the article number, outgoing address, and return address may be performed to generate a data file of such information for mailers prepared on a selected date. Further, it is to be understood that the printed mailers are sequentially folded using pressure-seal processing machines 64 known in the art, such as are commonly used by forms manufacturers and customers of form manufacturers; by way of example, the Moore 4800 Sealermate®system. It should be further understood that the term computer as used with reference to computer 62 is intended to encompass a single computer or a network of computers. Likewise, it should be understood that files 101 and 102 may be generated at separate computers and merged at computer 62.

The following examples illustrate the intended application of the method of use of the mailer. National chain retailers, having multiple retail outlets, and millions of customers, generate a significant number of bad check or overdue account notices each month. A third party service provider can use the disclosed mailer to notify each of these customers in a timely manner. Using printer 61 and processing machine 64, located at the service provider's business, and a computer 62 capable of creating or receiving files such as files 101 and 102 from a remote computer, the service provider physically prints the information on the mailers which are produced by a commercial printer, folds them using machine 64 and sends them to the customers. Using the current global computer network, sometimes referred to as the Internet, it is possible for the retailer to generate the mailing list into a file, e-mail the file to the service provider, and have the service provider handle the mailing and collection of the amounts due.

The mailer facilitates the process with the minimum number of personnel, inasmuch as the mailer is pre-printed with all necessary fields in appropriate colors. That is to say, the return receipt card and article number are printed in the proper color of green; however, the fields in which Optical Character Recognition or Bar-code technology are used by the post office are non-colored; therefore, the outgoing addressee may be electromechanically sorted and the return receipt card can also be electromechanically sorted for return. In contrast, standard return receipt cards have no non-colored field for the return address and cannot be electromechanically processed unless the original sender places an electromechanical label on the card. This necessitated the labor to transfer the label; if not, to perform an additional printing step. Further, since labels are not commonly used, the cost to the postal service can be significantly reduced if the present mailers are adopted and used to reduce the manual sorting of return receipt cards.

While I have disclosed the invention in one form, it is not so limited and the disclosure is intended to be by way of illustration in support of the scope of the appended claims.

What is claimed is:

1. A method of processing bulk certified mail comprising the steps of:

pre-printing a plurality of mailer forms each comprising a single sheet having first, second and third panels spaced longitudinally one from the other along said sheet and connected to one another along first and second longitudinally spaced, laterally extending fold lines between said first and second panels and said second and third panels, respectively; wherein a detachable postal return receipt card having a substantially white return address field is printed on said third panel, and defined thereon by a set of lines of perforation;

creating an information file containing a predetermined message in electronic format for printing on each of said plurality of mailer forms in a predetermined area on one face thereof;

creating an address file in electronic format containing addresses of a number of the intended recipients of said plurality of mailer forms for printing the address of each of the intended recipients on an individual one of said plurality of mailer forms;

merging said information file and said address file;

printing said merged information and address file on said mailer form, with said predetermined message printed on said one face of each mailer;

printing the address of an intended recipient a first time on a second face of each mailer in said second panel and printing the address of the intended recipient a second time in a field defined on said postal receipt card on said third panel, and printing a return address on said postal receipt card printed in said substantially white return address field on said second face;

folding first and second panels about said first fold line into registry with one another adhering one to one another along with said pattern of adhesive registering with said first face;

folding said third panel about said second fold line to register with and overlie said first panel along the second face of said sheet and adhering said first face of said third panel thereto along opposite margins thereof to form a completed mailer, each mailer bearing the address of the intended recipient, and having said postal receipt card integrally and detachably formed thereon.

2. The method of claim 1 wherein said files are created on different computers.

3. The method of claim 1 wherein one or more of said files is created on a remote computer and electronically transferred for said merging step to a local computer.

4. The method of claim 1 wherein said pre-printing step creates an inventory of mailer forms from which said plurality is selected.

5. The method of claim 1 wherein said pre-printing step includes the step of printing a unique sequential control number on said mailer form at a field on said postal receipt card and at least one other location.

6. The method of claim 1 wherein said files are transferred over a global computer network to a local computer for printing.

7. A method of processing bulk certified mail comprising the steps of:

providing a plurality of pre-printed mailer forms, each said mailer form comprising a single sheet having first, second, and third panels spaced longitudinally one from the other along said sheet and connected to one another along first and second longitudinally spaced, laterally extending fold lines between said first and second panels and said second and third panels, respectively; wherein a detachable postal return receipt card having a return address field is printed on said third panel, and defined thereon by a set of lines of perforation, said return address field having a coloration distinctly lighter than that of said detachable. postal return receipt card;

creating an information file containing a predetermined message in electronic format for printing on each of said plurality of mailer forms in a predetermined area on one face thereof;

creating an address file in electronic format containing addresses of a number of the intended recipients of said plurality of mailer forms for printing the address of each of the intended recipients on an individual one of said plurality of mailer forms;

merging said information file and said address file;

printing said merged information and address file on said mailer form on a single printer, with said predetermined message printed on said one face of each mailer;

printing the address of an intended recipient on both a second face of each mailer in said second panel and also in a field defined on said postal receipt card on said third panel, and printing a return address on said postal receipt card printed in said non-colored return address field on said second face;

folding first and second panels about said first fold line into registry with one another adhering one to one another along with said pattern of adhesive registering with said first face;

folding said third panel about said second fold line to register with and overlie said first panel along the second face of said sheet and adhering said first face of said third panel thereto along opposite margins thereof to form a completed mailer, each mailer bearing the address of the intended recipient, and having said postal receipt card integrally and detachably formed thereon.

8. A method of processing bulk certified mail comprising the steps of:

providing a plurality of pre-printed mailer forms, each said mailer form comprising a single sheet having first, second, and third panels spaced longitudinally one from the other along said sheet and connected to one another along first and second longitudinally spaced, laterally extending fold lines between said first and second panels and said second and third panels, respectively; wherein a detachable postal return receipt card having a return address field is printed on said third panel, and defined thereon by a set of lines of perforation, said return address field having a coloration contrasting with that of said detachable postal return receipt card;

creating an information file containing a predetermined message in electronic format for printing on each of said plurality of mailer forms in a predetermined area on one face thereof;

creating an address file in electronic format containing addresses of a number of the intended recipients of said plurality of mailer forms for printing the address of each of the intended recipients on an individual one of said plurality of mailer forms;

merging said information file and said address file;

printing said merged information file and address file on said mailer form on a single printer, with said predetermined message printed on said one face of each mailer;

printing the address of an intended recipient on both a second face of each mailer in said second panel and also in a field defined on said postal receipt card on said third panel, and printing a return address on said postal receipt card printed in said return address field on said second face;

folding first and second panels about said first fold line into registry with one another adhering one to one another along with said pattern of adhesive registering with said first face;

folding said third panel about said second fold line to register with and overlie said first panel along the second face of said sheet and adhering said first face of said third panel thereto along opposite margins thereof to form a completed mailer, each mailer bearing the address of the intended recipient, and having said postal receipt card integrally and detachably formed thereon.

9. A method of processing bulk certified mail comprising the steps of:

providing a plurality of pre-printed mailer forms, each said mailer form comprising a single sheet having first, second, and third panel, wherein said first panel is attached to said second panel along a first fold line and said second panel is connected to said third panel along a second fold line, wherein a detachable postal return receipt card having a return address field is printed on said third panel and defined thereon by a set of lines of perforation;

creating an information file containing a predetermined message in electronic format for printing on each of said plurality of mailer forms in a predetermined area on a first face thereof;

creating an address file in electronic format containing addresses of a number of the intended recipients of said plurality of mailer forms for printing the address of each of the intended recipients on an individual one of said plurality of mailer forms;

merging said information file and said address file;

printing said merged information file and address file on said mailer form on a single printer, with said predetermined message printed on said first face of each mailer;

printing the address of an intended recipient on both a second face of each mailer in said second panel and also in a field defined on said postal receipt card on said third panel, and printing a return address on said postal receipt card printed in said return address field on said second face;

folding first and second panels about said first fold line into registry with one another adhering one to one another along with said pattern of adhesive registering with said first face;

folding said third panel about said second fold line to register with and overlie said first panel along the second face of said sheet and adhering said first face of said third panel thereto along opposite margins thereof to form a completed mailer, each mailer bearing the address of the intended recipient, and having said postal receipt card integrally and detachably formed thereon.

* * * * *